United States Patent [19]

Jacobs et al.

[11] Patent Number: 4,742,953

[45] **Date of Patent: * May 10, 1988**

[54] HINGED COVER CARTON WITH INBOARD LOCKING EXTENSIONS

[75] Inventors: Kim Jacobs, Farmington; Raj K. Mangla, Pittsford, both of N.Y.

[73] Assignee: Mobil Oil Corporation, New York, N.Y.

[ * ] Notice: The portion of the term of this patent subsequent to Dec. 2, 2003 has been disclaimed.

[21] Appl. No.: 908,430

[22] Filed: Sep. 17, 1986

Related U.S. Application Data

[63] Continuation-in-part of Ser. No. 831,088, Feb. 20, 1986, Pat. No. 4,625,095, which is a continuation of Ser. No. 630,164, Jul. 12, 1984, abandoned, and a continuation-in-part of Ser. No. 723,715, Apr. 16, 1985, Pat. No. 4,625,906, which is a continuation-in-part of Ser. No. 481,512, Apr. 1, 1983, abandoned.

[51] Int. Cl.[4] ..... B65D 85/32

[52] U.S. Cl. ..... 229/2.5 EC; 229/125.29

[58] Field of Search ..... 229/2.5 EC, 45 EC, 44 EC, 229/29 M

[56] References Cited

U.S. PATENT DOCUMENTS

| | | | |
|---|---|---|---|
| 3,337,110 | 8/1967 | Commisso . | |
| 3,356,284 | 12/1967 | Lake . | |
| 3,648,916 | 3/1972 | Commisso . | |
| 3,661,320 | 5/1972 | Donadson | 229/2.5 EC |
| 3,672,693 | 6/1972 | Weir | 229/2.5 EC |
| 3,687,350 | 8/1972 | Warburton . | |
| 3,735,917 | 5/1973 | Warburton . | |
| 3,817,441 | 6/1974 | Jackson . | |
| 4,240,575 | 12/1980 | Tange | 229/2.5 EC |
| 4,295,597 | 10/1981 | Petersen | 229/2.5 EC |
| 4,382,536 | 5/1983 | Congleton | 229/2.5 EC |
| 4,383,638 | 5/1983 | Bixler | 229/2.5 EC |
| 4,419,068 | 12/1983 | Congleton | 229/2.5 EC |
| 4,492,331 | 1/1985 | Bixler et al. | 229/2.5 EC |
| 4,625,906 | 12/1986 | Mangla | 229/45 EC |

*Primary Examiner*—Joseph Man-Fu Moy

*Attorney, Agent, or Firm*—Alexander J. McKillop; Michael G. Gilman; Charles J. Speciale

[57] ABSTRACT

A carton molded from plastic resin has regions between the cells which extend upwardly and terminate at a top edge. The regions form a recess having a top which is a locking extension corresponding to each locking aperture in the cover. The edge of the locking aperture engages the locking extension within the confines of the cells so that the front wall of the bottom section forms the outermost front wall of the carton. In this manner, the cells have a maximum size for a given dimension of the carton.

21 Claims, 7 Drawing Sheets

HINGED COVER CARTON WITH INBOARD LOCKING EXTENSIONS

This application is a continuation-in-part of application Ser. No. 831,088 filed Feb. 20, 1986, now Pat. No. 4,625,095, which is a continuation of Ser. No. 630,164 filed July, 12, 1984, now abandoned. This application is also a continuation-in-part of application Ser. No. 723,715 filed Apr. 16, 1985, now Pat. No. 4,625,906, which is a continuation-in-part of application Ser. No. 481,512 filed Apr. 1, 1983, now abandoned.

BACKGROUND OF THE INVENTION

This invention relates to cartons with hinged covers which are formed from sheets of plastic materials by a thermoforming process. The invention is particularly applicable to egg cartons but may be applied to other types of cartons also, especially those which are used to carry fragile articles in separate packaging cells within the carton.

Egg cartons used in the retail marketing of eggs have, up to the present, usually contained one dozen eggs packaged in two rows of six eggs each. These cartons, which may be made of wood pulp or, more recently, of thermoformed plastic, generally comprise a bottom section containing the egg-receiving cells, a cover which is generally in the form of an inverted dish-like lid and a locking flap which engages with the cover to hold it closed. Various locking devices have previously been described or used. U.S. Pat. Nos. 3,337,110 and 3,356,284, for example, describe cartons which have a locking flap on the bottom section with a locking detent which engages with a locking flange on the cover. U.S. Pat. No. 3,648,916 describes a carton with a latching flap on the bottom section which has wedge-shaped recesses matching similar recesses on the cover. Latching bars on the recesses engage detents on the cover to provide the desired locking. Similar locking devices are shown in U.S. Pat. Nos. 3,687,350; 3,735,917; 3,817,441 and 3,908,891.

In some markets, eggs are sold in cartons of eighteen eggs, rather than in the traditional carton of one dozen. In the past, eighteen cell egg cartons have been thermoformed from plastic sheet only in versions which do not have complete protective covers although an eighteen cell carton with a protective cover has been produced in molded pulp. It would be desirable to be able to make an eighteen cell egg carton with an integral protective cover but the existing covered eighteen cell cartons such as the pulp carton presently on the market, cannot be thermoformed from plastic sheet. One reason is that the latch on the pulp carton has long elements, which, if thermoformed, would require a small, relatively narrow piece of the plastic sheet to be drawn a long way beyond the sheet line. In thermoforming, long extensions beyond the sheet line are generally undesirable because they produce considerable weakening.

On the other hand, it is not practicable to enlarge thermoformed plastic cartons of existing types by the inclusion of a third row of six egg cells, to form an eighteen cell carton because the enlarged cartons could not be accommodated on existing packaging equipment, a large amount of which is in use. Conventional packaging equipment is capable of accepting either covered twelve cell cartons with conventional locking flaps or the eighteen cell covered pulp cartons, both of which are small enough to fit within the equipment. If the twelve cell thermoformed plastic cartons were enlarged to hold eighteen eggs, the carton in the open position would exceed the maximum acceptable dimensions of 30×30 cm. (12×12 inches). The covered pulp carton mentioned above can be used on conventional equipment because its locking elements extend upwards from the lower section of the carton rather than sideways, as the locking flap does on the conventional plastic cartons.

The parent applications identified above describe a carton which is capable of holding eighteen eggs while still being filled on conventional packaging equipment. That carton has been successfully used in the packaging and marketing of eggs in eighteen cell lots.

It is desirable to increase the size of the egg cells in such a carton so that they can accommodate jumbo sized eggs. Moreover, it is desirable to increase the size of the cells without increasing the overall plan dimensions of the carton so that it can be filled on existing equipment.

It is an object of the present invention to provide a carton with enlarged cells which has a positive locking latch and which can be filled on existing machinery.

SUMMARY OF THE INVENTION

In accordance with the present invention, the latching elements on the bottom section of the carton are recess-shaped regions which extend upwardly and terminate in a locking extension which corresponds to a locking aperture in the cover of the carton. Each locking extension extends from the rear of the recess forward to the top front edge of the extension. The locking extension engages with the lower edge of the corresponding locking aperture when the cover is in the closed position.

In accordance with the invention, each locking extension is inward of the front of the bottom section. The edge of the locking aperture engages the locking extension within the confines of the cells. The front wall of the cells in the row of cells adjacent the front of the bottom section forms the outermost wall of the carton. In this manner, the cells have a maximum size for a given dimension of the carton.

More specifically, the size of the egg cells, from the front to the back of the carton, are increased by approximately 3/16" without increasing the overall dimensions of the carton. In this manner, a carton which can accommodate jumbo sized eggs is produced and the carton can be filled on conventional packaging equipment.

The foregoing and other objects, features and advantages of the invention will be better understood from the following detailed description and appended claims.

SHORT DESCRIPTION OF THE DRAWINGS

DESCRIPTION OF THE PREFERRED EMBODIMENT

Figure 1:
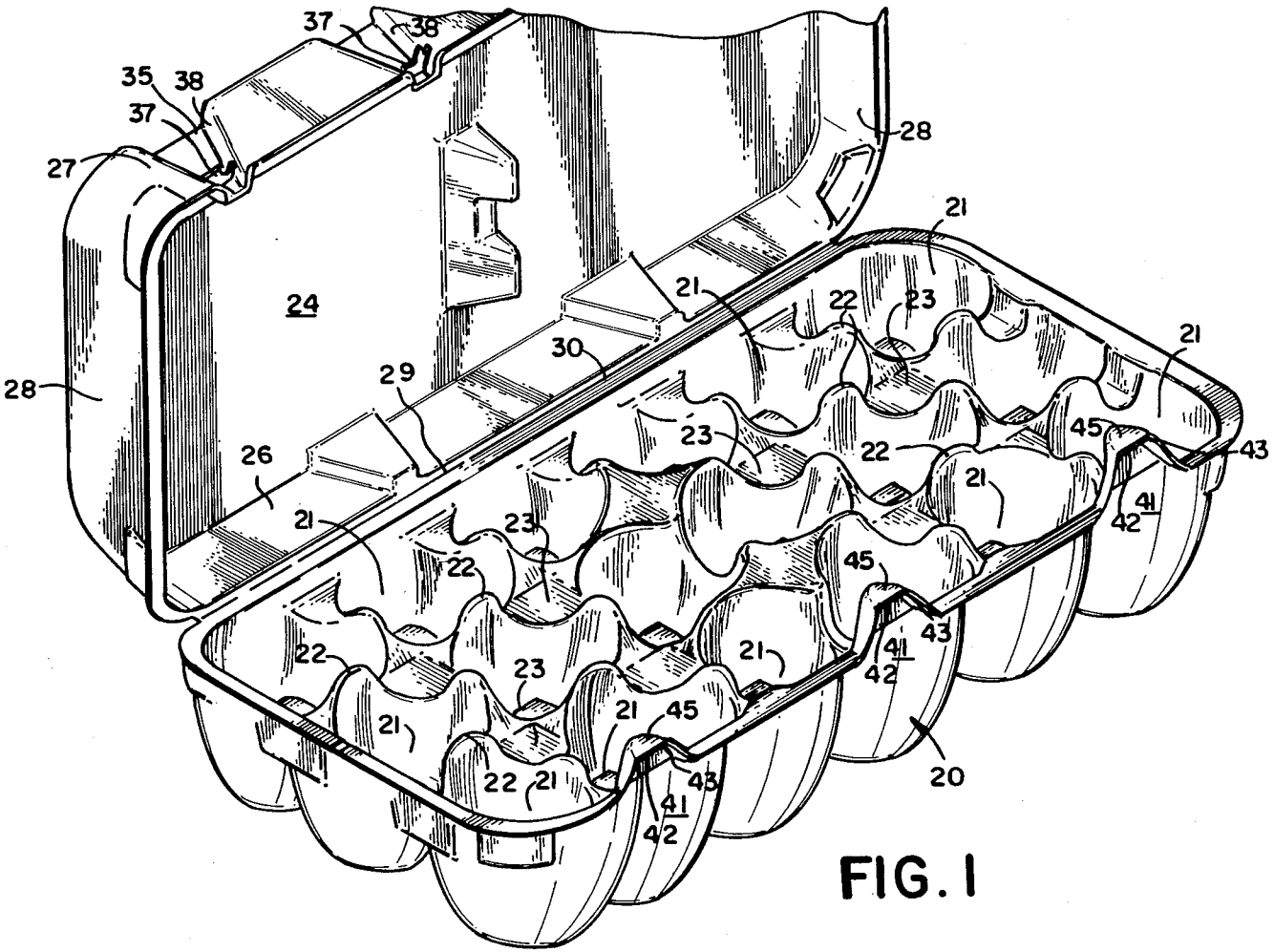
FIG. 1 is an isometric view of an eighteen cell plastic egg carton having the improved locking device of the present invention.

An eighteen cell egg carton of the present invention is shown in FIG. 1. It includes a bottom section 20 with egg receiving cells 21 arranged in three rows of six cells each. In order to provide a high degree of protection for the eggs, projecting tips 22 are provided between adjacent cells, both transversely and longitudinally. At the center of the carton the tips are omitted. The use of projecting tips between the egg cells to provide additional protection for the eggs is described in U.S. Pat. Nos. 3,563,446; 3,687,350; 3,817,441 and 3,908,891, to which reference is made for details of various arrangements for these tips, which may be used in the present cartons. Between each group of four tips, a depressed region 23 is provided to permit easy removal of the eggs.

The cover 24 is of inverted dish-like configuration and has a generally flat top 25, a rear wall 26, a front wall 27 and side walls 28. The cover is integrally formed with bottom section 20. Rear wall 26 is attached to the rear edge 29 of bottom section 20 by a resilient hinge 30 suitably of single or double fold configuration. Front wall 27 of the cover has a number of locking flutes or recesses 35 which are of wedge-shaped (trapezoidal) configuration although they may also be parallel-shaped or even of curvilinear configuration, if desired. In an alternative embodiment a locking flute may be situated between each pair of transverse, short (three cell) rows of egg cells, so that there is a total of five locking flutes. However, the number may be varied.

The rear face 36 of each locking flute 35 is offset inwardly from the remainder of the inner face of front wall 27 and a locking aperture 37 of slot-like configuration, is provided in each flute, extending along the rear face and into the two side walls 38 of each flute 35. The locking aperture is formed with a flat lower edge 39, preferably with a clean, sharp edge on the inside in order to provide firm, positive locking. The offset of each locking flute 35 increases from the bottom up to the locking aperture; i.e., in the direction from the edge of cover 24 towards aperture 37 so that as the cover is closed onto the bottom section, the sloping inner surfaces 40 of the locking recesses slide easily over the locking member on the bottom section until engagement occurs between the locking surfaces.

The regions 41 between the cells 21 extend upwardly and terminate at a top 42. The regions form a recess with the top 42 of each recess being a locking extension corresponding to each locking aperture. Each locking extension 45 extends from the rear of a recess forward to the top front edge 43. Each locking extension engages with the lower edge 39 of the corresponding locking aperture when the cover is in the closed position.

The locking extensions 45 are much shorter than the long extensions of prior art pulp carton. Therefore, they can be thermoformed from polystyrene and still be rigid. To accommodate the shorter locking extensions 45, the apertures 37 are lower on the cover than previously.

Each locking extension 45 is inward of the front of the bottom section of the carton. The lower edge 39 of each locking aperture engages the locking extension within the confines of the cells. The front wall of the cells in the row of cells adjacent the front of the bottom section forms the outermost front wall of the carton so that the cells have maximum size for a given dimension of the carton.

Figure 6:
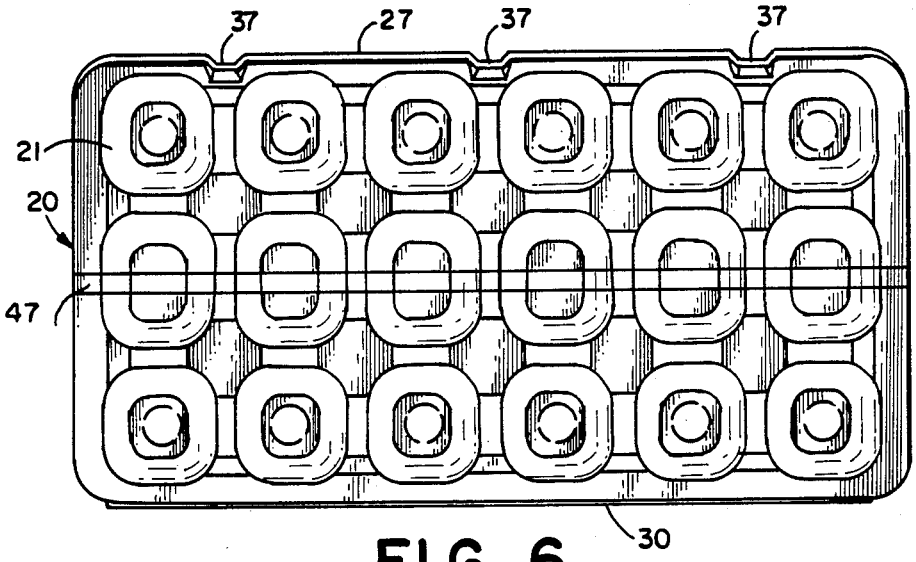
FIG. 6 is a bottom view showing the extra space obtained by the inboard latch.
Figure 7:
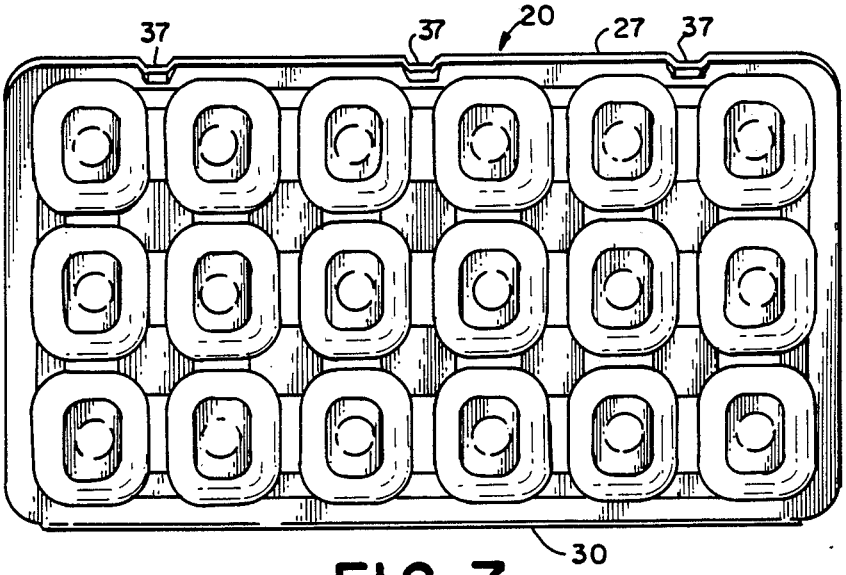
FIG. 7 is similar to FIG. 6, but shows the extra space distributed among three rows of cells.

Extra space is provided for the egg cells, in the front to back direction. This extra space is obtained without increasing the front to back overall dimension of the carton. In a typical eighteen cell egg carton of the type shown in the parent applications, approximately 3/16" in the front to back dimension is taken up by latches. Extra space for the cells is achieved by the latching mechanism of the present invention, which eliminates the latching space. The extra space obtained by the invention is shown at 47 in FIG. 6. This extra space is shown distributed among the three rows of egg cells in FIG. 7.

Figure 8:
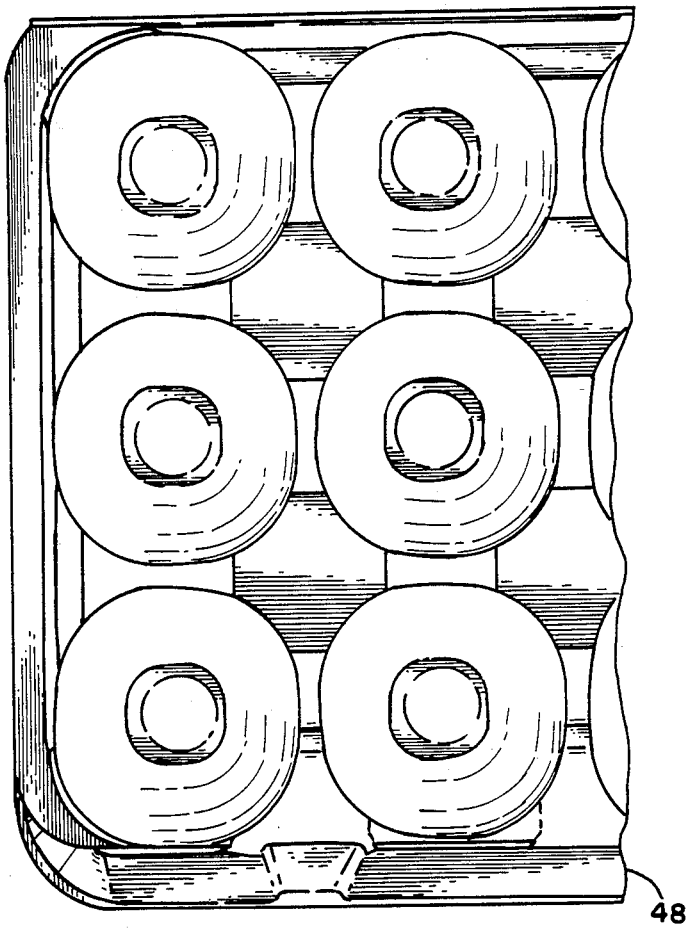
FIG. 8 is a partial bottom view of the prior carton of the parent applications.
Figure 9:
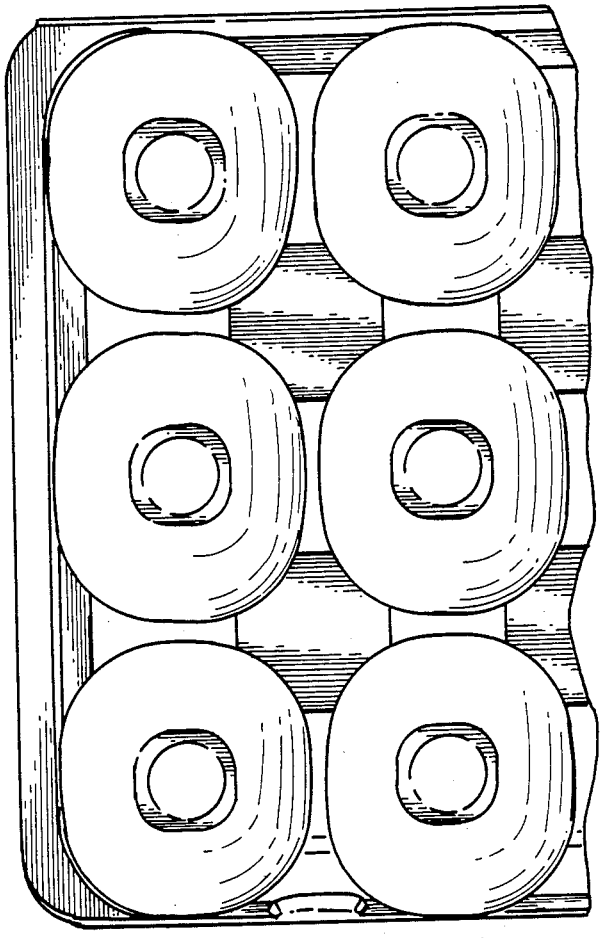
FIG. 9 is a partial bottom view of the carton of the present invention showing the added space for the three rows of cells and a preferred embodiment of the latch.

The advantage of extra space for the cells can be seen by comparing the bottom partial view of the eighteen cell carton of the parent applications, as shown in FIG. 8, with the same bottom partial view of the carton of the present invention as shown in FIG. 9. In the eighteen cell carton of FIG. 8, the cover overlaps the cell section by approximately 3/16". This overlap is indicated by the reference numeral 48. In the carton of the present invention, this overlap is eliminated, thereby providing extra space for the front to back dimensions of the egg cells.

Figure 2:
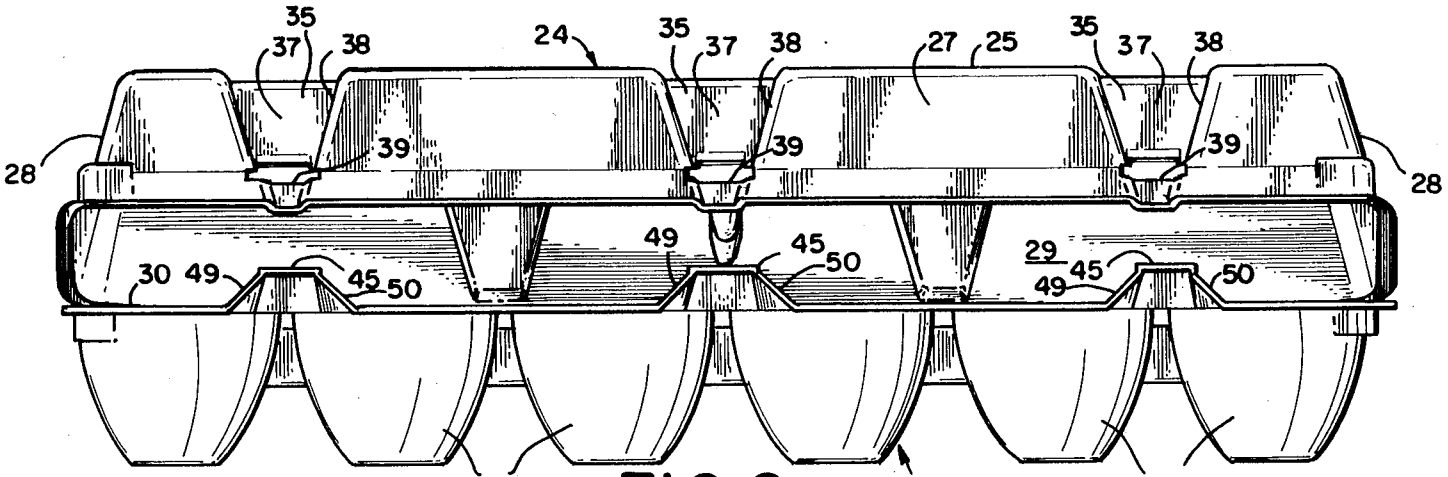
FIG. 2 is a front view of the carton in the partly open position.
Figure 3:
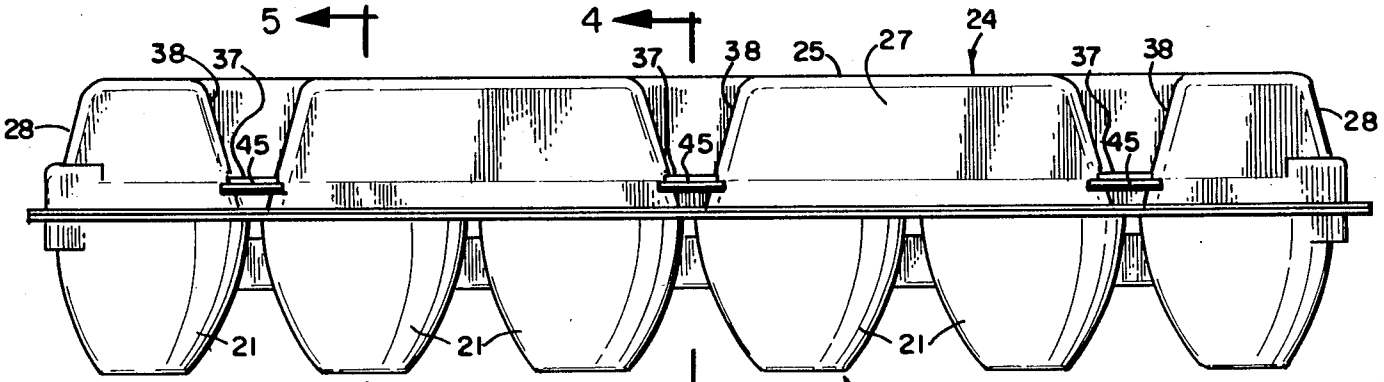
FIG. 3 is a front view of the carton in the fully closed position.
Figure 4:
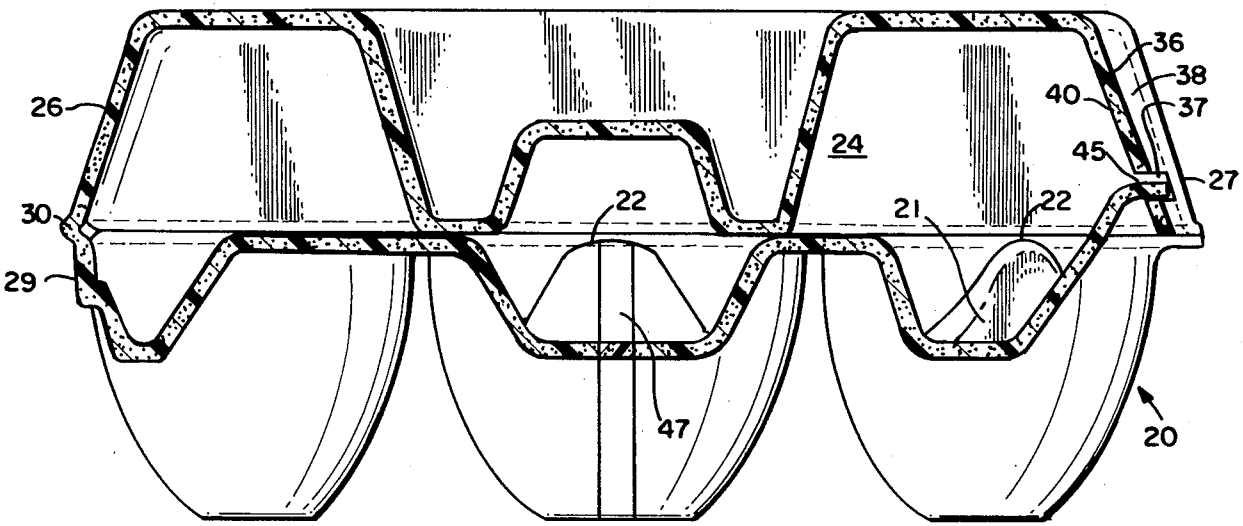
FIG. 4 is a view on the line 4—4 of FIG. 3.
Figure 5:
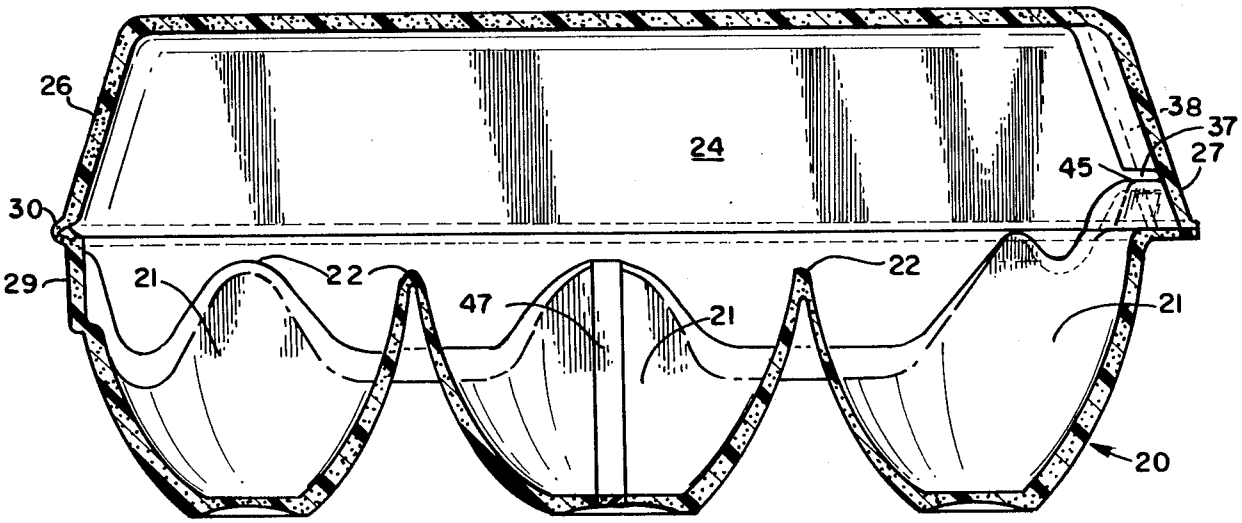
FIG. 5 is a view on the line 5—5 of FIG. 3.

Each recess has two side walls, 49 and 50, (FIG. 2) which extend outwardly and downwardly from the top of each recess. This makes it easier to thermoform the recess-shaped extensions. The outwardly extending side walls of each recess provide support for the extension so that it is a rigid, fixed, integral extension. The extension is located above the sheet line and is stretched in the opposite direction from the stretching of the cell section as more fully explained in the parent application. The carton is thermoformed by male and female dies from a polystyrene foam sheet, also as more fully explained in the parent applications.

While a particular embodiment of the invention has been shown and described, various modifications are within the true spirit and scope of the invention. The appended claims are, therefore, intended to cover all such modifications.

What is claimed is:

1. A carton moulded from a sheet of plastic resin material by thermoforming and comprising:

a bottom section having cells for receiving articles to be packaged;

a cover formed integrally with the bottom section and having a top, a front wall, side walls and a back wall which is resiliently hinged at its lower edge to the rear edge of the bottom section;

the front wall of the cover having a plurality of inwardly extending locking flutes with a locking aperture in at least some of said flutes;

the regions between at least some of said cells extending upwardly and terminating at a top edge, said regions forming a recess with the top of each recess being a locking extension corresponding to each locking aperture, each locking extension extending from the rear of a recess forwards to said top front edge, each locking extension engaging with the lower edge of the corresponding locking aperture when the cover is in the closed position.

2. The carton recited in claim 1 wherein each extension is inward of the front of said bottom section, the edge of said locking aperture engaging said locking extension within the confines of said cells, the front wall of said cells in the row of cells adjacent the front of said bottom section forming the outermost front wall of said carton so that said cells have maximum size for a given dimension of said carton.

3. The carton recited in claim 1 wherein each recess has two side walls which extend outwardly and downwardly from said top of each recess.

4. A carton according to claim 1 in which each locking flute has a trapezoidal configuration, narrow at the bottom edge of the front wall of the cover, increasing in width towards the top of the cover.

5. A carton according to claim 1 in which each locking flute is inwardly offset from the front wall of the cover and of increasing depth from the bottom edge of the front wall of the cover up to the locking aperture.

6. A carton according to claim 2 in which each locking flute is inwardly offset from the front wall of the cover and of increasing depth from the bottom edge of the front wall of the cover up to the locking aperture.

7. A carton according to claim 1 in which each locking aperture extends from the rear of each flute to the rear face of the front wall of the cover.

8. A carton according to claim 4 in which each locking aperture extends from the rear of each flute to the rear face of the front wall of the cover.

9. A carton according to claim 7 in which each locking aperture has a slot-like configuration extending along the locking flute in which it is situated.

10. A carton according to claim 8 in which each locking aperture has a slot-like configuration extending along the locking flute in which it is situated.

11. A carton according to claim 1 in which said regions are formed by an upward extension of the plastic sheet material from the sheet line during the thermoforming operation.

12. A carton according to claim 1 in which the locking apertures are aligned longitudinally to define an interrupted channel in which said locking extensions are received when the carton is closed.

13. A carton for the packaging of eggs and the like thermoformed by male and female dies from a polystyrene foam plastic sheet having a sheet line comprising:

a cell section formed from said plastic sheet to define a plurality of cells extending from the sheet line in one direction for reception of packaged articles and of a depth such that said articles are enclosed thereby for a portion less than their vertical dimension as packaged;

a plurality of fixed integral cell section extensions located above the sheet line and stretched in an opposite direction from said one direction;

a dished cover resiliently hinged to the rear edge of said cell section, said cover being formed from said plastic sheet to define a front wall, a back wall, and end walls extending in said one direction from said sheet line and fixed to each other and to a top for said cover;

a plurality of flutes in said front wall of said cover each having an offset surface which is inwardly offset with respect to said front wall, and a hole in said offset surface;

said extensions each having a horizontal latching element located at a terminal end of said extension, each latching element being complementary to one of said flutes in said front wall, each latching element projecting outwardly through a complementary one of the holes in the inwardly offset surface of said cover and within the confines of said flute to latch said carton in the closed position.

14. The carton recited in claim 13 in which each locking flute has a trapezoidal configuration, narrow at the bottom edge of the front of the cover, increasing in width towards the top of the cover.

15. The carton recited in claim 13 in which each locking flute is inwardly offset from the front wall of the cover and of increasing depth from the bottom edge of the front wall of the cover up to the locking aperture.

16. The carton recited in claim 13 wherein said latching elements are latch bars.

17. The carton recited in claim 13 wherein said cell section has the same plan dimensions as said dished cover so that said carton can be processed in the same packaging machinery used to pacakge articles in coverless cell sections.

18. The carton recited in claim 17 wherein said cell section has eighteen cells and wherein said dimensions are such that one of said cartons with its cover open fits in the packaging machinery adapted to receive two eighteen coverless cell sections.

19. The carton recited in claim 13 further comprising:

said latching elements including a latch bar which extends across each of said flutes, said latch bar projecting through the hole in the complementary flute and within the confines of said flute.

20. The carton recited in claim 13 further comprising:

a rectangular post extending from the inside of the top of said cover toward said cell section when said carton is in the closed condition to maintain said eggs in position in said cell section.

21. A carton moulded from a sheet of plastic resin material by thermoforming and comprising:

a bottom section having cells for receiving articles to be packaged;

a cover formed integrally with the bottom section and having a top, a front wall, side walls and a back wall which is resiliently hinged at its lower edge to the rear edge of the bottom section;

the front wall of the cover having a plurality of inwardly extending locking flutes with a locking aperture in at least some of said flutes;

a plurality of recess shaped extensions of the front wall of said bottom section, each extension having a latching bar on the underside of the top of the extension and two side walls which extend outwardly and downwardly from said latching bar, each extension being between two adjacent cells in the row of cells adjacent the front of said bottom section, each extension being inward of the front of said cell section, the edge of each locking aperture engaging a latching bar with the confines of said cells, the front wall of said cells in the row of cells adjacent the front of said bottom section forming the outermost front wall of said carton so that said cells have maximum size for a given dimension of said carton.

* * * * *